United States Patent [19]

Davis, Jr.

[11] 4,323,295

[45] Apr. 6, 1982

[54] TWO-PIECE STRAIN RELIEF AND CONNECTORIZED FLAT CABLE ASSEMBLY FORMED THEREWITH

[75] Inventor: Dwight M. Davis, Jr., Pickerington, Ohio

[73] Assignee: Western Electric Company, Incorporated, New York, N.Y.

[21] Appl. No.: 154,549

[22] Filed: May 29, 1980

[51] Int. Cl.[3] ..... H01R 13/58

[52] U.S. Cl. ..... 339/107

[58] Field of Search ..... 339/97 P, 98, 99 R, 339/103 R, 103 M, 107

[56] References Cited

U.S. PATENT DOCUMENTS

| | | | |
|---|---|---|---|
| 3,691,509 | 9/1972 | Krol | 339/14 |
| 3,904,261 | 9/1975 | Cooney | 339/17 |
| 3,997,234 | 12/1976 | Worman | 339/105 |
| 4,005,921 | 2/1977 | Hadden et al. | 339/14 |
| 4,080,038 | 3/1978 | Latta et al. | 339/103 M |
| 4,111,512 | 9/1978 | Parmer et al. | 339/105 |
| 4,149,026 | 4/1979 | Fritz et al. | 174/32 |
| 4,188,083 | 2/1980 | Knowles | 339/99 |
| 4,243,288 | 1/1981 | Lucius et al. | 339/99 R |
| 4,269,466 | 5/1981 | Huber | 339/107 |

*Primary Examiner*—Joseph H. McGlynn
*Attorney, Agent, or Firm*—K. R. Bergum

[57] ABSTRACT

A two-piece strain relief member (15), and a flat cable-strain relief member-connector assembly (10) are disclosed, wherein the member (15) is comprised of two complementary sections (15*a*, 15*b*) molded out of plastic material. Each member section is formed with first and second elongated planar wall portions (31*a*, *b* or 32*a*, *b*), with the second wall portion being oriented at an angle relative to the associated first wall portion, and terminating in a laterally disposed, cable-contacting rearward edge portion (31*c* or 32*c*). Each member section is also formed with an outwardly extending integral pin (36 or 37) and an outwardly tapered locking detent (41 or 42) respectively located near, and as a portion of, one end wall (31*d* or 32*d*), and with a pin-receiving bore (57 or 58) and a U-shaped locking latch (62 or 63) respectively located near, and as a portion of, the opposite end wall (47*a* or 48*a*). A laterally disposed connector-engaging forward boss (76 or 77) in each member section is adapted to nest within one of two laterally disposed and accommodating recesses (11*a*′ or 11*a*″) formed on opposite sides of an associated housing (11*a*) of a connector (11).

22 Claims, 7 Drawing Figures

TWO-PIECE STRAIN RELIEF AND CONNECTORIZED FLAT CABLE ASSEMBLY FORMED THEREWITH

BACKGROUND OF THE INVENTION

1. Field of the Invention

This invention relates to the connectorization of flat cable and, in particular, to the strain-relief anchoring thereof, as secured to an associated connector.

2. Background of the Invention

In connectorizing flat cable of the type having a plurality of laterally disposed conductors arranged in either a single array, or in multiple overlying/underlying arrays, it is imperative that the connectorized ends of the cable conductors be isolated from any possible detrimental tensile or shear forces. Such forces, without reliable strain relief being provided, can often lead to seriously impaired cable conductor-connector contact connections, if not actual open-circuits, regardless whether such connections are of the soldered, or solderless type. Appreciable stress can often be imparted on a connectorized length of cable during not only the subsequent reeling and de-reeling thereof, but also during its installation in electrical equipment or in buildings.

Thus, regardless of the manner in which a given flat cable is connectorized, some form of strain relief must be employed in order to insure the integrity of the established interconnections. One of the most simple techniques employed heretofore to effect cable strain relief is to thread an end portion of a terminated cable through two or more openings or slots formed in either a rearward integral portion of a connector housing, or in an auxiliary member secured to a rearward portion of the latter.

Such a slotted member forces that portion of the cable threaded therethrough into a tortuous or serpentine path, with the resulting sharp bends imparted to the cable effectively anchoring it from longitudinal movement relative to the associated connector. Concomitantly, this form of strain relief also isolates the electrical connections from otherwise possible detrimental shear forces during normal handling of the connectorized cable. One form of this type of cable strain relief is disclosed in J. N. Worman U.S. Pat. No. 3,997,234, wherein the strain relief openings are actually formed in a so-called plug package handle (often referred to as a paddle board) secured to, rather than formed as an integral part of, a connector housing per se.

A disadvantage of a tortuous path-defined type of strain relief is that it is often quite difficult, depending primarily on the degree of stiffness, and thickness, of the cable, to thread an end portion of the latter through the necessary strain relief-forming slots or openings. In addition, it is likewise difficult to determine initially how much of a terminated end portion of the cable should be threaded through the strain relief-defining slots so that the normally stripped ends of the conductors may be consistently brought into not only aligned, but co-extensive, relationship with the respective connector receptacles or contacts, as required to effect either solder or solderless type connections therebetween.

Another form of cable strain relief is provided by utilizing an independent multi-sectioned clamping device, typically formed of two complementary, interlockable molded plastic sections, dimensioned so as to provide a frictional-engaging passageway therebetween for an end region of a terminated cable. In one prior strain relief device of this type, each complementary plastic section thereof is formed with a laterally disposed, centrally positioned rib that normally supports a U-shaped resilient insert, such as of rubber. These inserts are employed to frictionally engage and clamp opposite sides of a terminating section of cable interposed therebetween. The molded sections of the strain relief device are also constructed such that when assembled and interlocked, a laterally disposed forward boss thereof is adapted to be received within an accommodating recess formed in a rearward housing portion of an associated connector.

Each strain relief section of the prior type in question is also formed at one end with an outwardly extending U-shaped locking detail, and at the other end with a protruding locking shoulder. The shoulder in each strain relief section is adapted to engage a mating surface of the U-shaped detail in the complementary section, when the two sections are assembled with a terminating section of a cable interposed therebetween. One form of such a multi-sectioned strain relief device is sold by the AMP Corporation, with one particular version thereof, without a pair of resilient inserts being employed therewith, being disclosed in W. B. Fritz et al. U.S. Pat. No. 4,149,026.

Disadvantageously, it has been found that such unadjustable two-piece strain relief devices, even when resilient inserts are employed therewith, do not always reliably and consistently effect the clamping of an end portion of a terminated flat cable therebetween. This results, in part, from the fact that the resilient inserts tend to lose their resiliency and, hence, their initial clamping force capability, with time.

This has been found to present a particular problem when connectorized flat cable is employed in telephone undercarpet wiring installations, where continuous running lengths of such cable may often be on the order of 15 to 35 ft., as distinguished from lengths of from less than one foot to no more than several feet in many telephone switching and computer equipment wiring applications. It thus becomes readily apparent that when relatively long lengths of connectorized flat cable are either drawn off a supply reel, or otherwise uncoiled, and then laid out along a floor in accordance with a prescribed path, the electrically connected conductor ends of such cables necessarily are subjected to appreciable tensile, as well as shear, forces in the absence of some type of effective strain relief being provided.

Another disadvantage in having to utilize resilient inserts is that they double the number of parts required to assemble a complimentary multi-sectioned strain relief device. This not only increases manufacturing costs, but increases the possibility of the inserts becoming separated from the main molded sections of the device before their interlocked assembly.

SUMMARY OF THE INVENTION

It, therefore, is an object of the present invention to provide a simplified, inexpensive and reliable interlockable two-piece strain relief member for positively anchoring an unstripped end portion of a flat cable to an associated connector, and in a manner whereby no tensile or shear forces can be exerted on the cable conductor-connector contact connections, while the latter are also shielded by the strain relief member, and a composite connectorized cable assembly incorporating, and positively interlocked by, such a strain relief member.

In accordance with the principles involved in one preferred illustrative strain relief member embodiment, each complimentary section of the latter is molded out of a suitable plastic material, and is formed with an outwardly extending integral pin and a locking detent respectively located near, and as a portion of, one laterally disposed end wall, and with a pin-receiving bore and a U-shaped locking latch respectively located near, and as a portion of, the opposite end wall. Each strain relief member section also includes a laterally disposed cable-contacting rearward edge, and a connector-engaging forward boss, the latter adapted to nest within one of two laterally disposed and accommodating recesses formed on opposite sides of an associated connector.

During assembly, the laterally disposed and oppositely projecting pins of the mutually disposed strain relief sections are initially respectively inserted through different ones of two pre-formed apertures located along opposite borders near the end of a terminated cable, and then each pin is inserted into the respectively aligned bore formed in the complementary strain relief section. At that time, the forward bosses in the two sections are also nested within the respectively associated recesses of the connector. The two sections, as thus assembled and intercoupled with the cable and connector, are interlocked upon the U-shaped locking latch in each section engaging a protruding abutment of the associated locking detent of the other section. The strain relief sections may be permanently interlocked, if desired, through the use of a suitable bonding cement, or by being ultrasonically bonded together. As assembled, the wall portions of the two strain relief sections are also advantageously configured so that in cooperation with the interconnected cable and connector, the electrical connections are completely shielded from the environment.

DETAILED DESCRIPTION OF THE INVENTION

It should be appreciated that while the invention is described in detail herein primarily in regard to reliably anchoring one preferred type of flat cable to one preferred type of connector of the solder type, the strain relief member embodied herein is also applicable for use with many other diverse types of flat cables and connectors, with the same beneficial results being realized therewith.

Figure 1:
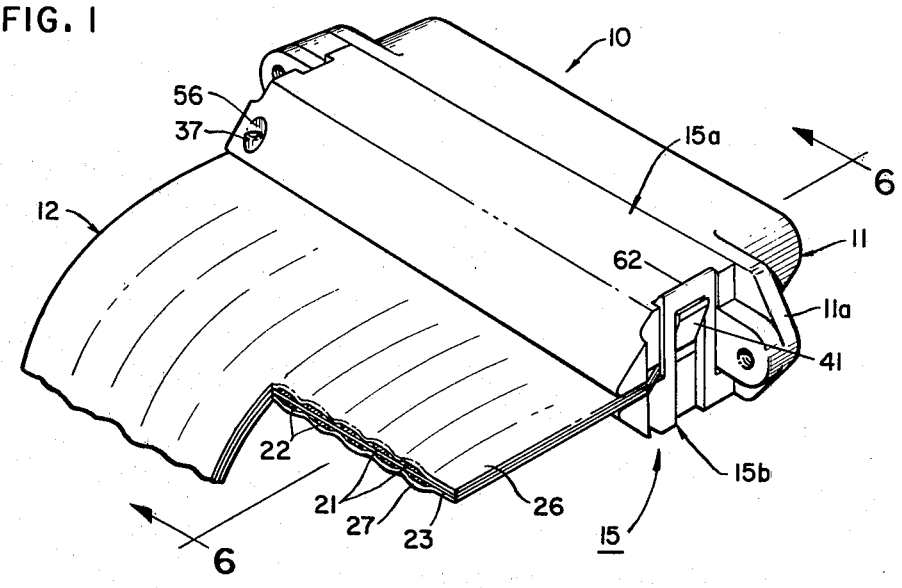
FIG. 1 is a perspective view, partially in section, of a connectorized flat cable assembly, including a two-piece strain relief member interlocked with both an associated cable and connector, in accordance with the principles of the present invention.
Figure 2:
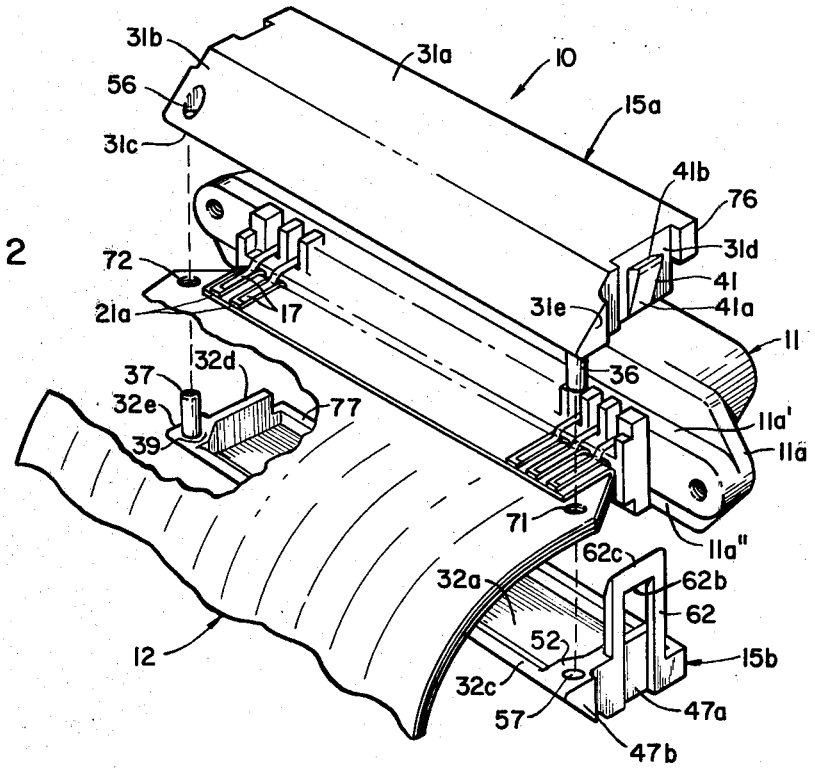
FIG. 2 is an exploded perspective view of the composite cable-connector-strain relief assembly of FIG. 1, with the fragmentary portion of the cable shown partially broken away, and illustrates in greater detail the structural features of the composite strain relief member as embodied in the present invention.

With particular reference now to FIGS. 1 and 2, there is disclosed a connectorized flat cable assembly 10 comprised of a card-edge type connector 11, a flat cable 12, of the multi-conductor-array type, and a unique strain relief member 15 constructed in accordance with the principles of the present invention.

Figure 6:
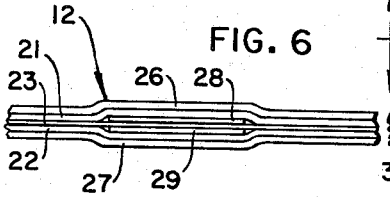
FIG. 6 is a sectional side view of the composite flat cable-connector-strain relief assembly of FIG. 1, taken along the line 6—6 of the latter FIG.

As illustrated, the connector 11 has two mutually disposed arrays of outwardly extending, resilient contacts 17, 18, only one array being seen in FIG. 2, but with contacts of both arrays being seen in FIG. 6. Such contacts may be adapted for use in effecting either solder or solderless connections. Connectors of this type are available from a number of different companies, one being sold under the tradename Amp Champ card-edge connector, by the AMP Corporation.

The cable 12 illustrated is of the type disclosed in a co-pending application of W. A. Elliott-T. J. Taylor, Ser. No. 106,599, filed Dec. 26, 1979, which is also assigned to the same assignee as the present invention. As constructed, the cable 12 comprises two overlying-/underlying arrays of conductors 21, 22 that are separated by a common center insulative film 23, with each array of conductors being laminated between the center film and an associated one of two outer films 26 or 27. The respective conductors in the two arrays are precisely offset a predetermined distance from each other in a manner that has been found to effect exceptionally low crosstalk characteristics. Also preferably incorporated in such a cable, as fabricated, are a plurality of isolating strips 28, 29 (only seen in FIG. 6) which are positioned transversely across, and on each side of, the center film 23 in aligned pairs at each of a succession of predetermined spaced terminating sites (e.g., at 5, 10 or 15 ft. intervals) along the cable.

Figure 7:
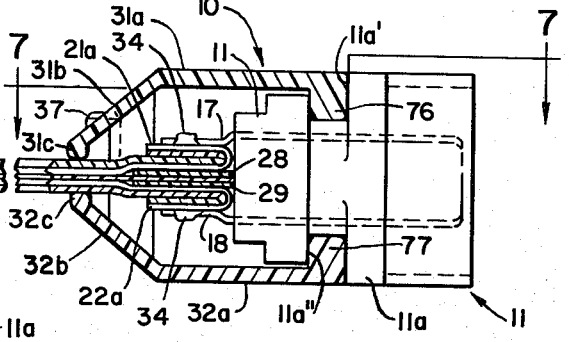
FIG. 7 is a fragmentary plan view, taken along the line 7—7 of FIG. 6, of several terminated conductors in the upper array of the cable, as soldered to the overlying, and slightly offset mating contacts of the connector, and which view further illustrates in greater detail the location of one strain relief locking pin, as inserted through an aligned cable receiving hole, in the composite connectorized cable assembly in accordance with the principles of the present invention.
Figure 7:
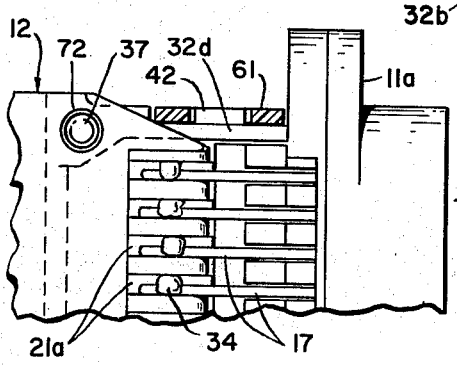

As further illustrated in FIGS. 2 and 6, the cable is preferably terminated for connectorization by having short end sections of the outer films 26, 27, together with the co-extensive and respectively associated arrays of conductor end portions 21*a*, 22*a* bonded thereto, folded back upon themselves so as to advantageously expose the major outer surfaces of the conductor end portions for mating contact with the respectively aligned contacts of the connector 11. By terminating the cable in this manner, a normally required insulation-stripping operation is advantageously obviated. For purposes of illustration only, the mating cable conductor ends and connector contacts are shown in FIGS. 6 and 7 as being optionally permanently secured together by solder fillets 34. Further details of such a unique flat cable terminating and connectorization technique are more fully described, together with the significant benefits realized therewith, in another co-pending application of T. J. Taylor, Ser. No. 135,033, filed March 28, 1980, and also assigned to the same assignee as the present invention. As previously noted, however, it should be appreciated that the composite strain relief member 15 embodied herein may be used with many other types of flat cables and connectors, whether interconnected in accordance with either solder or solderless techniques, with the same beneficial strain-relief results being realized therewith.

With particular reference now to the strain relief member 15, as best seen in FIGS. 2–6, it is comprised of two complementary sections 15*a* and 15*b*, molded out of suitable low shrinkage plastic material, such as polycarbonate resin. Each section has two elongated planar wall portions 31*a, b* or 32*a, b*, with the rearward wall portions 31*b*, 32*b* each being oriented at an angle relative to the associated one of the wal portions 31*a* or 32*a*, and terminating in a laterally disposed rearward edge or nose portion 31*c* or 32*c*, preferably having a rounded contour. Such mutually disposed edge portions, upon assembly of the composite strain relief member, are adapted to contact the respectively associated sides of the cable 12 when interposed therebetween. As also best seen in FIGS. 2, 4 and 5, the major wall portions 31*a, b* or 32*a, b* respectively intersect end wall portions 31*d, e* or 32*d, e*.

Figure 3:
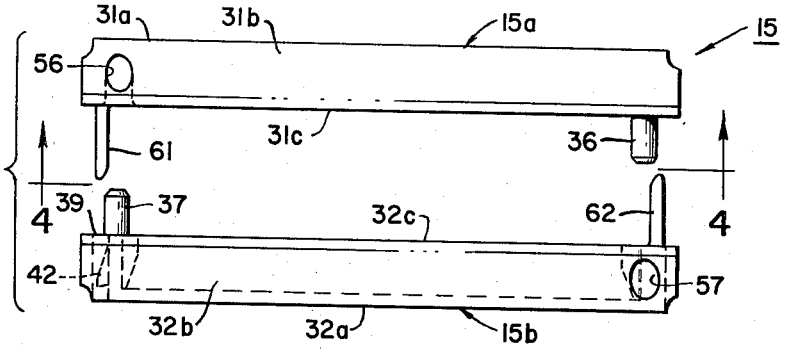
FIG. 3 is an exploded, detail rear view of the complementary sections of the strain relief member depicted in FIGS. 1 and 2.
Figure 4:
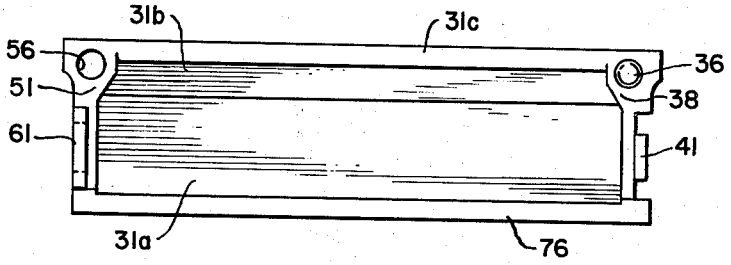
FIG. 4 is a plan view of the underside of the upper strain relief section depicted in FIGS. 1–3, taken along the line 4—4 in FIG. 3.
Figure 5:
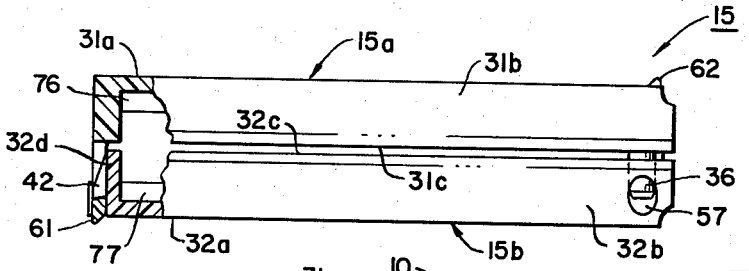
FIG. 5 is an enlarged, rear elevational view, partially in section, showing the relative positions of certain structural details of the two complementary sections of the strain relief member after their assembly, without a terminating portion of a flat cable being interposed therebetween for purposes of clarity.

In accordance with another aspect of the invention, each strain relief section 15*a, b* is formed near one end with an outwardly extending intergral pin 36 or 37. As best seen in FIGS. 2–4, each pin extends from an integral raised boss 38 or 39 formed on the underside wall portion 31*b* or 32*b* of each strain relief section, and is oriented in a direction perpendicular to the associated wall portion 31*a* or 32*a*. The bosses 38, 39 actually comprise extensions of the triangular end wall portions 31*e*, 32*e*, and have outer surfaces that are flush with, and merge into, the rounded rearward edge portions 31*c*, 32*c* of the respectively associated strain relief sections 15*a*, 15*b*.

A wedge-shaped locking detent 41 or 42 is formed in the end wall portion 31*d* or 32*d* of each strain relief section 15*a* or *b*. Each of these detents has an outwardly tapered face portion 41*a* or 42*a*, and an upper locking abutment 41*b* or 42*b*.

The opposite end of each strain relief section 15*a, b* is formed by end wall portions 46*a, b* or 47*a, b* (only selectively seen in FIGS. 2, 4 and 5), these end walls being integral with the respectively associated major sidewall portions 31*a, b* or 32*a, b*. Each triangular-shaped end wall portion 46*b* or 47*b* merges into an integral raised boss 51 or 52 (only selectively seen in FIGS. 2 and 4), with the outer surface of each such boss also being flush with the rounded rearward edge portion 31*c* or 32*c* of the respectively associated strain relief section. Each of the bosses 51, 52 is formed with an associated bore 56 or 57, the diameter of which is chosen to accommodate, in close-fitting relationship therewith, the associated pin 36 or 37 of the complimentary strain relief section when the two sections are brought into interlocked engagement.

Also formed as an integral extension of each end wall portion 46*a*, 47*a* is an integral U-shaped locking latch 61 or 62. Each latch, as in the case with the associated one of the pins 36, 37, extends perpendicularly outward from the underside of the major planar wall portion 31*a* or 32*a* of the associated strain relief section, and defines a rectangular opening 61*a* or 62*a* dimensioned to receive therewithin the mating wedge-shaped locking detent 41 or 42 of the complimentary strain relief section.

In order to effect positive and reliable interlocking engagement of the two complementary strain relief sections 15*a, b*, the upper locking abutment 41*b* or 42*b* of each wedge-shaped locking detent, and a respectively mating inner surface 61*b* or 62*b* of a horizontal leg portion 61*c* or 62*c* of each U-shaped locking latch, are preferably formed, as molded, to have complementary reverse tapers, such as on the order of 3 to 15 degrees relative to the major outer planar surface of the associated wall portion 31*a* or 32*a*.

The latches 61, 62 are also preferably dimensioned, particularly in thickness, so as to exhibit relatively stiff resiliency to outward, laterally directed flexure. As such, the outwardly tapered surface 41*a* or 42*a* of each locking detent will cause the mating U-shaped latch 61 or 62 to become slightly flexed outwardly before the upper horizontal leg portion 61*c* or 62*c* thereof snaps into locking engagement with the upper mating detent abutment 41*b* or 42*b*. At that time, it is also seen that the major portion of the inner surface of each U-shaped latch is biased against the end wall portion 31*d* or 32*d* of the associated strain relief section 15*a* or 15*b*, with each outwardly protruding wedge-shaped locking detent 41 or 42 then also being nested within the rectangular opening of the mating latch.

In accordance with the principles of the present invention, the pins 36, 37 are significantly employed not only to position and maintain the strain relief sections 15*a* and *b* in precise alignment after assembly, but to provide a positive means to reliably interlock a section of flat cable 12, when interposed therebetween, with the associated connector 11. Considered more specifically, the cable 12 is either formed during its manufacture, or at least prior to the time of its connectorization, with two laterally spaced apertures 71, 72. Each aperture is inset a predetermined distance from a different longitudinal edge, and from the terminated end, of the cable so as to be in lateral alignment. As thus formed and located, each aperture 71 or 72 is adapted to receive a different one of the pins 36 or 37 of the associated strain relief section, as best seen in FIGS. 2, 6 and 7.

Each strain relief section is also formed at its forward end with an integral, laterally disposed boss 76 or 77. Each boss extends outwardly from the underside of the associated forward wall portion 31*a* or 32*a*, and is dimensioned so as to be received within an accommodating, close-fitting recess 11*a'* or 11*a''* formed in a rearward portion of a connector housing 11*a*, normally of molded plastic. As previously noted, there are a number of commercially available connectors manufactured with similar compatible recesses, which advantageously obviate the need for any auxiliary fastening elements or straps to secure the unique strain relief member embodied herein to many diverse types of commercially available flat cable connectors.

As a result of the unique construction of the composite strain relief member 15, it can be readily assembled to provide a very reliable strain relief function in a flat cable-strain relief-connector assembly 10 in the following manner. First, the two complementary strain relief member sections 15*a* and 15*b* are oriented into mutually disposed relationship, while positioned on opposite sides of a terminated and connectorized end portion of the cable 12, as depicted in FIG. 2. While so positioned, the two laterally disposed and oppositely projecting pins 36, 37 in the strain relief sections are brought into alignment with, and inserted through, the respectively aligned pre-formed cable apertures 71, 72, before being inserted into the respectively aligned receiving bores 56, 57.

As previously noted, the pre-formed apertures 71, 72 in the cable may be formed either during the fabrication of the cable, or alternatively, at the time that a terminated end thereof is to be connectorized in the field. With respect to the one preferred type of flat cable 12 disclosed herein, the number of strain relief member-accommodating apertures formed along the borders of the cable may be limited to only those spaced regions therealong that are immediately adjacent a given pair of cable terminating isolating strips 28,29. Such strips are normally positioned within the cable at predetermined intervals on the order of 5, 10 or 15 feet.

Upon the pins 36, 37 being fully inserted into the respectively aligned bores 56, 57 of the mutually disposed strain relief member sections, as best seen in FIGS. 1, 6 and 7, the two U-shaped latches 61 and 62 snap over the respective locking detents 41,42. When thus assembled, the composite strain relief member 15 is not only interlocked with the cable 12 through the pin-aperture engagements established therebetween, but is also interlocked with the associated connector 11 as a result of the forward bosses 76,77 being nested within different ones of the receiving recesses 11*a*′, 11*a*″ formed in the rearward portion of the housing of the connector, as manufactured. It is also significant to note that the resulting compressive forces imparted by the rearward, laterally disposed strain relief section edge portions 31*c*,32*c* are only relied upon to prevent any dust, other fine particle debris, or contaminants from contacting the enclosed conductor-contact connections.

The resiliently interlocked strain relief sections may be permanently secured, if desired, through the use of a suitable bonding cement (not shown), preferably applied to selected interfacing end wall surfaces of the engaged locking detents and latches, or by ultrasonically bonding such interfacing surfaces together, for example. However, by properly choosing the type of plastic material employed to form the strain relief sections, and by also properly dimensioning and shaping the locking detents and latches thereof, permanent securement of the strain relief sections through a bonding operation is normally not required.

In summary, the composite cable strain relief member 15, as thus constructed, is seen to provide positive interlocked engagement of the terminated cable 12 to the connector 11 in a manner that prevents any possible tensile forces or shear stress to be imparted on the terminated cable conductors, and which strain relief member requires no auxiliary parts such as resilient rubber inserts, binding straps or threaded fastening members, for example, to produce reliable and consistent anchoring of the terminated cable to the associated connector. In addition, the complementary strain relief sections are also configured so as to cooperate with the associated cable and connector to effect reliable shielding of the conductor-contact connections from the outside environment.

While a preferred flat cable strain relief member, as well as flat cable-strain relief-connector assembly, have been disclosed herein, it is obvious that various modifications may be made to the present illustrative embodiment of the strain relief member, and composite assembly formed therewith, and that a number of alternative related embodiments could be devised by one skilled in the art without departing from the spirit and scope of the invention.

What is claimed is:

1. A strain relief member for a connectorized flat cable, comprising:

two complementary molded plastic sections, each section including:

a. forward and rearward elongated planar wall portions, the latter being angularly oriented relative to the former, and extending in a direction toward the complementary wall portion of the other section when they are assembled;

b. a pin-receiving bore formed in one side of said member section near one end thereof;

c. an integral pin extending outwardly from said one side, and near the other end, of said member section, and being oriented for insertion into said bore in the other complementary section;

d. an integral locking detent extending outwardly from said one side of said member section, and located at the other end thereof;

e. a boss extending perpendicularly outward from said one side of said forward wall portion, said boss being adapted to be received within an accommodating recess of an associated connector when said member sections are subsequently assembled in interlocked relationship therewith, and f. a locking latch extending outwardly from said one end and side of said member section, said latch in each section being adapted to snap into locking engagement with the detent of the other section when said complementary sections are brought into close mutually disposed relationship, with only the thickness of a terminating section of an associated cable interposed therebetween, such that the pin of each section is inserted within said bore of the other member section, while the boss of each section is nested within a receiving recess of an associated connector, said pins being further adapted, when said member sections are interlocked, to also extend through respectively aligned pre-formed apertures formed along opposite border regions of an interposed terminating section of cable so as to reliably anchor the latter to an associated connector.

2. A strain relief member in accordance with claim 1 wherein each locking detent forms a portion of an end wall at said other end of each member section, said detent having an outwardly tapered face portion terminating in a latch-engaging abutment, and wherein said locking latch in each member section is of U-shaped configuration, extending outwardly from, and forming a portion of, an end wall located at said one end of each member section, said latch having a rectangular opening adapted to receive the outwardly tapered protruding portion of the mating detent of the other member section, as assembled.

3. A strain relief member in accordance with claim 2 wherein in each section thereof the surface of said detent abutment, and the abutment-engaging surface of said locking latch, have complementary reverse tapers so as to effect more positive, interlocked engagement between said member sections when assembled on opposite sides of a terminated section of connectorized flat cable.

4. A strain relief member in accordance with claim 2 wherein in each section thereof said bore is formed in, and said associated pin extends from, respective bosses, each boss being formed as an integral extension of a different end of said rearward wall portion, and the end wall adjacent thereto.

5. A strain relief member for a connectorized flat cable, comprising:

two complementary molded plastic sections, each section including:

a. first and second elongated planar wall portions, the second being inclined at a predetermined angle from the first so as to define an obtuse angle therebetween;

b. an integral pin extending outwardly from the underside of said second inclined wall portion near one end of said member section, and being oriented perpendicularly relative to said first wall portion;

c. a locking detent forming a portion of an underside end wall located at said one end of said member section;

d. a pin-receiving bore formed in said member section near the other end thereof, the axis of said bore being parallel with said laterally disposed pin;

d. a pin-receiving bore formed in said member section near the other end thereof, the axis of said bore being parallel with said laterally disposed pin;

e. an elongated boss extending perpendicularly outward from the underside of said first wall portion along the edge thereof furthest from said second elongated wall portion, said boss being adapted to be received within an accommodating recess of an associated connector when said strain relief member sections are subsequently assembled in interlocked relationship therewith, and f. a U-shaped locking latch extending outwardly from, and forming a portion of, an underside end wall located at said other end of said member section, said latch being oriented in parallel relation to said laterally disposed pin, and being adapted to snap into locking engagement with the detent of the other section when said two complementary sections are brought into close mutually disposed relationship, with only the thickness of a terminating section of an associated cable interposed therebetween, such that the pin of each section is inserted within the bore of the other section, while the boss of each section is nested within a receiving recess of an associated connector, said pins being further adapted, when said member sections are assembled, to also extend through respectively aligned pre-formed apertures formed along opposite border regions of an interposed terminating section of cable so as to reliably anchor the latter to said strain relief member and to an associated connector compatible therewith.

6. A strain relief member in accordance with claim 5, wherein said sections thereof are configured such that when interlocked with an associated terminating section of flat cable and a connector, the wall portions of the member sections cooperate with the associated cable and connector to substantially completely shield the electrical cable-connector connections from the environment.

7. A strain relief member in accordance with claim 6 wherein said detent of each section thereof has an outwardly tapered face portion that terminates at one end in a protruding abutment, the surface of which, together with a mating surface formed on a center leg portion of said U-shaped locking latch in the other member section, are formed with complementary reverse tapers so as to effect a more positive locking action between said sections when assembled.

8. A strain relief member in accordance with claim 7 wherein said second inclined wall portion of each section thereof defines a rearward, laterally disposed edge having a rounded contour, said edge being positioned so as to be resiliently biased against an adjacent side of a terminating section of a flat cable when interposed between said two sections of the composite strain relief member, as assembled.

9. A strain relief member in accordance with claim 7 wherein in each section thereof said bore is formed in, and said associated pin extends from, respective bosses, each boss being formed as an integral extension of a different end of said second wall portion, and the end wall adjacent thereto.

10. A connectorized flat cable assembly, comprising:

a connector having at least one laterally disposed array of cable conductor-mating elements supported within an associated housing, a rearward portion of said housing having two mutually disposed recesses formed therein;

a flat cable of given length having at least one laterally disposed array of conductors isolated from each other within a flat, insulative jacket, and wherein the terminating ends of said conductors are adapted for, and are respectively positioned in, electrical engagement with said conductor-mating elements of said connector, said flat cable also being fabricated with at least two laterally disposed pin-receiving apertures, each being formed within a different border region of said cable, and located a predetermined distance from the terminated end thereof, and a composite strain relief member, said member being comprised of two complementary molded plastic sections, each section including:

a. forward and rearward elongated planar wall portions, the latter being angularly oriented relative to the former, and extending in a direction toward the complementary wall portion of the other section as assembled;

b. a pin-receiving bore formed in one side of said member section near one end thereof;

c. an integral pin extending outwardly from said one side, and near the other end, of said member section, and being oriented for insertion into said bore in the other section;

d. an integral locking detent extending outwardly from said one side of said member section, and located at the other end thereof;

e. a boss extending perpendicularly outward from said one side of said forward wall portion, said boss being adapted to be received within an associated one of said recesses of said connector upon said member sections being assembled in interlocked relationship therewith, and f. a locking latch extending outwardly from said one end and side of said member section, said latch in each section being adapted to snap into locking engagement with the detent of the other section, upon said complementary sections having been brought into close mutually disposed relationship, with only the thickness of a terminating section of said cable interposed therebetween, such that the pin of each member section is inserted first through an aligned one of the apertures formed near the terminated end of said cable, and secondly within said bore of the other member section, while the boss of each section is nested within the associated one of the recesses of said connector, said interlocked strain relief member sections thereby reilably anchoring said cable to said connector.

11. A connectorized flat cable assembly in accordance with claim 10, wherein said locking detent in each strain relief member section forms a portion of an end wall at said other end thereof, said detent having an outwardly tapered face portion terminating in a latch-engaging abutment, and wherein said locking latch in each member section is of U-shaped configuration, extending outwardly from, and forming a portion of, an end wall located at said one end of each member section, said latch having a rectangular opening adapted to receive the outwardly tapered protruding portion of the mating detent of the other member section, as assembled.

12. A connectorized flat cable assembly in accordance with claim 11, wherein in each section thereof the surface of said detent abutment, and the abutment-engaging surface of said locking latch, have complementary reverse tapers so as to effect more positive, interlocked engagement between said member sections as assembled on opposite sides of the terminating end section of said connectorized cable, and wherein in each of said strain relief member sections, said bore is formed in, and said associated pin extends from, respective bosses, each boss being formed as an integral extension of a different end of said rearward wall portion, and the end wall adjacent thereto.

13. A connectorized flat cable assembly, comprising:

a connector having at least one laterally disposed array of cable conductor-mating elements supported within an associated housing, a rearward portion of said housing having two mutually disposed, and laterally extending, recesses formed therein;

a flat cable of given length having at least one laterally disposed array of conductors isolated from each other within a flat, insulative jacket, and wherein the terminating ends of said conductors are adapted for, and are respectively positioned in, electrical engagement with said conductor-mating elements of said connector, said flat cable also being fabricated with at least two laterally disposed pin-receiving apertures, each being formed within a different border region of said cable, and located a predetermined distance from the terminated end thereof, and a composite strain relief member, said member being comprised of two complementary molded plastic sections, each section including:

a. first and second elongated planar wall portions, the second being inclined at a predetermined angle from the first so as to define an obtuse angle therebetween;

b. an integral pin extending outwardly from the underside of said second inclined wall portion near one end of said member section, and being oriented perpendicularly relative to said first wall portion;

c. a locking detent forming a portion of an underside end wall located at said one end of said member section;

d. a pin-receiving bore formed in said member section near the other end thereof, the axis of said bore being parallel with said laterally disposed pin;

e. an elongated boss extending perpendicularly outward from the underside of said first wall portion along the edge thereof furthest from said second elongated wall portion, said boss being adapted to be received within an associated one of said recesses of said connector upon said member sections being assembled in interlocked relationship therewith, and f. a U-shaped locking latch extending outwardly from, and forming a portion of, an underside end wall located at said other end of said member section, said latch being oriented in parallel relationship to said laterally disposed pin, and being adapted to snap into locking engagement with the detent of the other section, upon said two complementary sections having been brought into close mutually disposed relationship, with only the thickness of a terminating section of said cable interposed therebetween, such that the pin of each member section is inserted first through an aligned one of the apertures formed near the terminated end of said cable, and secondly within said bore of the other member section, while the boss of each section is nested within an associated one of the recesses of said connector, said interlocked strain relief member sections thereby reliably anchoring said cable to said connector.

14. A connectorized flat cable assembly in accordance with claim 13 wherein in each of said strain relief member sections, said bore therein is formed in, and said associated laterally disposed pin extends from, respective bosses, each boss being formed as an integral extension of a different end of said second wall portion, and the end wall adjacent thereto.

15. A connectorized flat cable assembly in accordance with claim 13 wherein said sections of said composite strain relief member are configured such that when interlocked with the terminating section of said associated flat cable and connector, the wall portions of the member sections cooperate with the associated cable and connector to substantially completely shield the cable conductor-connector mating element connections from the environment.

16. A connectorized flat cable assembly in accordance with claim 15 wherein said locking detent in each strain relief member section has an outwardly tapered face portion that terminates at one end in a protruding abutment, the surface of which, together with a mating surface formed on a center leg portion of said U-shaped locking latch in the other member section, are formed with complementary reverse tapers so as to effect a more positive locking action between said sections when assembled.

17. A connectorized flat cable assembly in accordance with claim 16 wherein said second inclined wall portion of each strain relief member section defines a rearward, laterally disposed edge having a rounded contour, said edge being positioned so as to be resiliently biased against an adjacent side of a terminating section of said flat cable interposed therebetween, as assembled.

18. A connectorized flat cable assembly in accordance with claim 17, wherein said complementary sections of said strain relief member are permanently interlocked by being bonded together at selected interfacing end wall regions thereof.

19. A connectorized flat cable assembly in accordance with claim 16 wherein said U-shaped latch of each strain relief member section defines a rectangular opening adapted to receive the protruding portion of said locking detent formed in the other member section, and wherein said surfaces of said member sections are formed with reverse tapers having complementary angles of between 3 and 15 degrees relative to the plane of said first elongated wall portion of said associated member section.

20. A connectorized flat cable assembly in accordance with claim 19 wherein selected interfacing end wall regions of said strain relief member sections, as assembled, are permanently interlocked by being bonded together.

21. A connectorized flat cable assembly in accordance with claim 19 wherein in each of said strain relief member sections, said bore therein is formed in, and said associated laterally disposed pin extends from, respective bosses, each boss being formed as an integral extension of a different end of said second wall portion, and the end wall adjacent thereto.

22. A strain relief member for a connectorized flat cable, comprising:

two engageable molded plastic sections, each section including:

a. forward and rearward elongated planar wall portions, the latter being angularly oriented relative to the former, and extending in a direction toward the corresponding wall portion of the other section when they are assembled;

b. a pin-receiving bore formed in one side of said member section near one end thereof;

c. an integral pin extending outwardly from said one side, and near the other end, of said member section, and being oriented for insertion into said bore in the other engageable section;

d. an integral locking detent extending outwardly from said one side of said member section, and located at the other end thereof;

e. a boss extending perpendicularly outward from said one side of said forward wall portion, said boss being adapted to be received within an accommodating recess of an associated connector when said member sections are subsequently assembled in interlocked relationship therewith, and f. a locking latch extending outwardly from said one end and side of said member section, said latch in each section being adapted to snap into locking engagement with the detent of the other section when said engageable sections are brought into mutually disposed relationship, with only the thickness of a terminating section of an associated cable interposed therebetween, said pins being further adapted, when said member sections are interlocked, to also extend through respectively aligned pre-formed apertures located along opposite border regions of such an interposed section of cable so as to reliably anchor the latter to said member.

* * * * *